United States Patent [19]

Simonsson

[11] Patent Number: 4,688,294

[45] Date of Patent: Aug. 25, 1987

[54] VACUUM CLEANER NOZZLE

[75] Inventor: Sven B. Simonsson, Stockholm, Sweden

[73] Assignee: Aktiebolaget Electrolux, Sweden

[21] Appl. No.: 857,074

[22] Filed: Apr. 29, 1986

[51] Int. Cl.[4] ..... A47L 9/06

[52] U.S. Cl. ..... 15/367; 15/393; 15/398; 15/417

[58] Field of Search ..... 15/416, 417, 402, 398, 15/393, 400, 367

[56] References Cited

U.S. PATENT DOCUMENTS

| | | | |
|---|---|---|---|
| 1,936,369 | 11/1933 | Riebel et al. | 15/402 |
| 2,351,507 | 6/1944 | Hallock | 15/416 X |
| 2,960,716 | 11/1960 | Kemnitz | 15/417 |
| 3,108,311 | 10/1963 | House | 15/417 |
| 3,659,313 | 5/1972 | Ferris | 15/402 |
| 3,833,962 | 9/1974 | Krusche | 15/400 |

*Primary Examiner*—Chris K. Moore

*Attorney, Agent, or Firm*—Alfred E. Miller

[57] ABSTRACT

A vacuum cleaner nozzle comprises a housing (10) having first and second air inlets (13,15) adapted to different cleaning duties. Each of the inlets is connected to a respective outlet (17,19) via a separate duct (16,18). The outlets are arranged on different sides of the housing and are separated by a partition (20) to form two independent sockets for a tube handle connected to a vacuum source.

5 Claims, 4 Drawing Figures

VACUUM CLEANER NOZZLE

The present invention relates to a vacuum cleaner nozzle, comprising a housing having first and second air inlets adapted to different cleaning purposes, the first air inlet being connected to a first air outlet via a first duct and the second air inlet being connected to a second air outlet via a second duct.

Nozzles of the above-mentioned type, so-called combination nozzles, are previously known and are used e.g. for cleaning of upholstered as well as hard furniture, shelves, pictures, and so on. These nozzles are relatively small in order to facilitate handling and accessibility. They have a first air inlet opening surrounded by a brush for cleaning of hard surfaces, and a second air inlet opening surrounded by hard edges to be used on soft material. In one such type of a nozzle the two openings are arranged opposite to each other, and when air and dust are flowing in through one opening the other opening is serving as a holder for a tube handle belonging to the vacuum cleaner, and vice versa. The tube handle is in turn in connection with a fan assembly via a dust bag. One of the openings is enlarged by folding out two nozzle portions. One disadvantage of this type of nozzle is that it comprises morable portions which complicates the manufacture of the nozzle.

In a similar type of combination nozzle having two separate air inlets, the two outlets have such a mutual disposition that the tube handle blocks one outlet while communicating with the other, and vice versa. A disadvantage of this arrangement is that the portion of the nozzle to which the tube handle is connected must be made with high precision since otherwise leakage might occure, or difficulties in fitting and keeping the tube handle in the nozzle.

The object of the present invention is to provide a sturdy nozzle of plastic which is made in one piece and does not suffer from the above defined disadvantages. This has been obtained by a nozzle according to the invention as defined in the subsequent claims.

Figure 1:
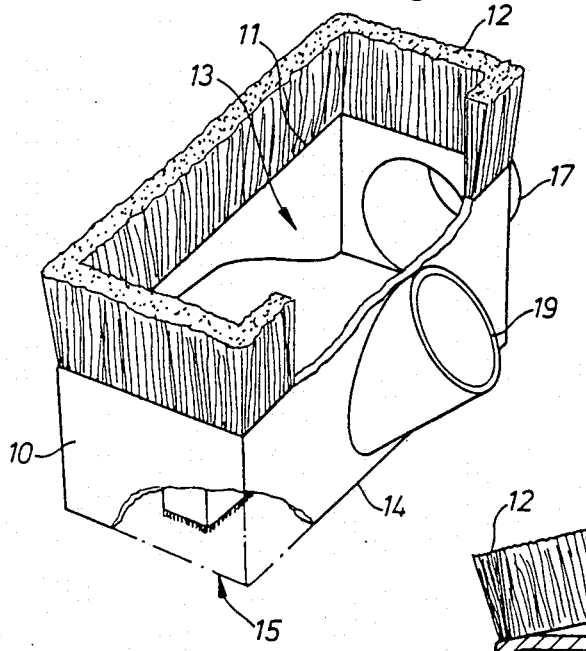
Figure 3:
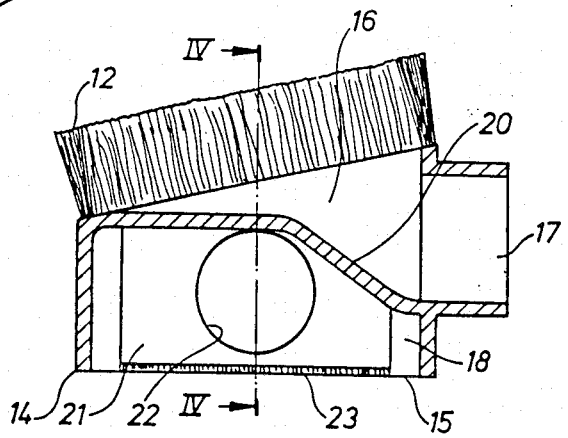
Figure 2:
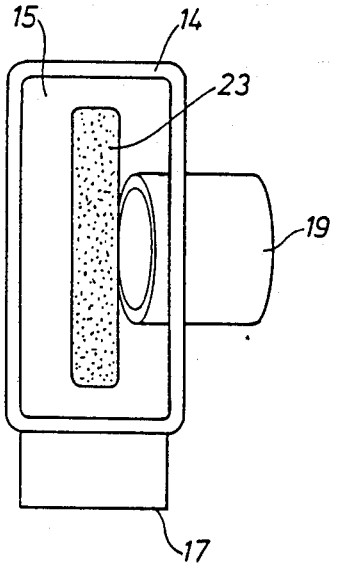
Figure 4:
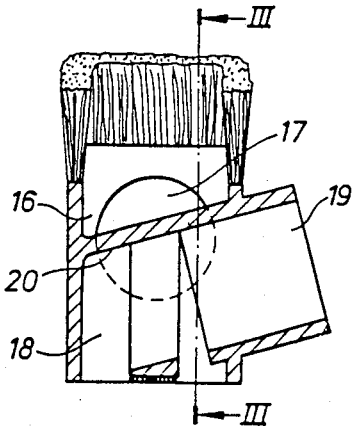

An embodiment of the invention will now be described with reference to the accompanying drawing, in which FIG. 1 is a partially cut-away perspective view of a nozzle according to the invention, FIG. 2 is a bottom plan view of the nozzle shown in FIG. 1, FIG. 3 is a longitudinal section of the nozzle along line III—III in FIG. 4, and FIG. 4 is a section along line IV—IV in FIG. 3.

As appears from the figures the nozzle comprises a housing 10 having a generally box-like configuration. The housing is preferably of plastic and is made in one piece. The upper rim 11 of the housing 10 is inclined upwards and backwards in FIG. 1 and has a brush strip 12 surrounding a first air inlet opening of the nozzle. The lower rim of the housing is designated 14 and is disposed in one and the same horisontal plane, thereby forming a second air inlet opening 15. The first inlet opening 13 is connected to a first outlet opening 17 via a first duct 16, and the second inlet opening 15 is connected to a second outlet opening 19 via a second duct 18. The two ducts are separated by a sealing partition 20 which divides the nozzle into two separate halves. The second duct 18 is provided with a central vertical wall portion 21 having a through opening 22 disposed opposite to the outlet opening 19. The lower portion of wall 21 forms a surface 23 which is generally in the same plane as the rim 14 of the nozzle and is covered with a material having bristles extending therefrom and intended to pick up threads and hairs and the like during the cleaning operation, such objects being difficult to take up by pure suction action.

I claim:

1. A vacuum cleaner nozzle provided with a tube handle and comprising a generally rectangular housing having first and second air inlets for different cleaning purposes, first and second ducts and first and second outlets, said outlets each piercing an exterior wall of said housing, a partition separating said housing into two non-communicating ducts whereby the outlets are arranged on different sides of said housing and separated by said partition to thereby form two independent sockets for said tube handle connected to a vacuum source.

2. A vacuum cleaner nozzle as claimed in claim 1 further comprising a brush surrounding said first air inlet and further comprising a plane hard rim portion surrounding said second air inlet.

3. A vacuum cleaner nozzle as claimed in claim 2 wherein said second air inlet is provided with a surface having a material for picking up threads and the like, said surface being situated inside said hard rim portion and on the same level thereof.

4. A vacuum cleaner nozzle as claimed in claim 1 wherein said air inlets are generally rectangular in shape.

5. A vacuum cleaner nozzle as claimed in claim 1 wherein the housing is a one-piece element fabricated of plastic.

* * * * *

UNITED STATES PATENT AND TRADEMARK OFFICE

CERTIFICATE OF CORRECTION

PATENT NO. : 4,688,294

DATED : August 25. 1987

INVENTOR(S) : Sven B. Simonsson

It is certified that error appears in the above-identified patent and that said Letters Patent is hereby corrected as shown below:

ON THE TITLE PAGE, INSERT:

-- [30] Foreign Application Priority Data

May 3, 1985 [S.E] Sweden.....8502153-3 --.

Signed and Sealed this

First Day of March, 1988

*Attest:*

*Attesting Officer*

DONALD J. QUIGG

*Commissioner of Patents and Trademarks*